United States Patent [19]

Mizutani

[11] Patent Number: 4,837,943

[45] Date of Patent: Jun. 13, 1989

[54] DIELECTRIC DRYING PROCESS FOR HONEYCOMB STRUCTURES

[75] Inventor: Isao Mizutani, Nagoya, Japan

[73] Assignee: NGK Insulators, Ltd., Japan

[21] Appl. No.: 136,542

[22] Filed: Dec. 22, 1987

[30] Foreign Application Priority Data

Dec. 27, 1986 [JP] Japan ..... 61-309278

[51] Int. Cl.[4] ..... B01K 5/00

[52] U.S. Cl. ..... 34/1; 34/68

[58] Field of Search ..... 34/1, 68; 219/10.67, 219/10.69, 10.81; 264/25, 26, 57, 58, 209.1; 425/174, 178.8 R

[56] References Cited

U.S. PATENT DOCUMENTS 2,737,569 3/1956 Brown et al. ..... 34/1

4,439,929 4/1984 Kitagawa et al. ..... 34/1

*Primary Examiner*—Henry A. Bennet

*Attorney, Agent, or Firm*—Arnold, White & Durkee

[57] ABSTRACT

A process for dielectric-drying a honeycomb structure is carried out by placing the honeycomb structre on a drying support board provided with perforated plates, and directing an electric current between an electrode arranged above the upper opening end face of the honeycomb structure and an electrode arranged beneath the lower opening end face thereof to conduct the drying. In this process, an upper plate having a conductivity higher than that of the honeycomb structure is placed on the upper opening end face of the honeycomb structure.

2 Claims, 2 Drawing Sheets

DIELECTRIC DRYING PROCESS FOR HONEYCOMB STRUCTURES

BACKGROUND OF THE INVENTION

1. Field of the Invention

This invention relates to an improvement in a dielectric drying process for honeycomb structures.

2. Related Art Statement

Heretofore, the dielectric drying process has been carried out in order to dry the honeycomb structure of a ceramic green structural body obtained by extruding a ceramic material through a die and having many parallel through-holes isolated from each other by partition members each having an approximately uniform wall thickness. That is, the honeycomb structure was set between opposed electrodes and then an electric current was applied across the electrodes to conduct molecular motion of dipolar of water in the inside of the honeycomb structure through the generated high frequency energy, during which the honeycomb structure was dried by the friction heat accompanied therewith.

However, when the honeycomb structure is dried by the above dielectric drying process, there is caused a drawback in that the density of the electric force line passing through the honeycomb structure becomes non-uniform. In order to solve this drawback, the inventor has previously proposed, in U.S. Pat. No. 4,439,929, a drying support board composed of a perforated plate, a predetermined region of which, inclusive of a portion contacting with a lower opening end face of the honeycomb structure, has a conductivity higher than that of the other remaining peripheral portion thereof.

When the honeycomb structure is subjected to a dielectric drying by using the above drying support board, the density distribution of the electric force line becomes uniform to a certain extent, but the density in the upper portion of the honeycomb structure is still non-uniform, and consequently the drying of the upper portion in the honeycomb structure becomes slow as compared with the other remaining portion. That is, the drying shrinkage in the dry-delaying portion is small as compared with that of other portion, so that the dimensional scattering is caused between the upper portion and the lower portion in the honeycomb structure after the dielectric drying and hence the dimensional accuracy lowers. As a result, the size of the upper portion becomes undesirably larger than that of the lower portion.

Furthermore, when the drying of the upper portion in the honeycomb structure is delayed to form a high-moisture region in this upper portion, if the draft drying or firing is carried out after the dielectric drying, the shrinkage becomes large only in the highmoisture region and cracks are apt to be caused.

Therefore, the following has been provided which is capable of uniformly subjecting the honeycomb structure to dielectric drying without delaying the drying of the honeycomb structure as a whole.

SUMMARY OF THE INVENTION

It is, therefore, an object of the invention to solve the aforementioned drawbacks of the conventional technique and provide a dielectric drying process for the production of honeycomb structures having improved dimensional accuracy.

According to the invention, there is provided a process for dielectric-drying a honeycomb structure by placing the honeycomb structure on a drying support board composed of a perforated plate, a given region of which, inclusive of a portion contacting with a lower opening end face of the honeycomb structure, has a conductivity higher than that of the other remaining portion, and directing an electric current between an electrode arranged above the upper opening end face of the honeycomb structure and an electrode arranged beneath the lower opening end face thereof to conduct the drying, characterized in that an upper plate having a conductivity higher than that of the honeycomb structure is placed on the upper opening end face of the honeycomb structure.

BRIEF DESCRIPTION OF THE DRAWINGS

The invention will be described with reference to the accompanying drawings, wherein.

DESCRIPTION OF THE PREFERRED EMBODIMENTS

According to the invention, not only the density of electric force line at the lower portion of the honeycomb structure is made uniform by the conventional support board, but also the density of electric force line at the upper portion of the honeycomb structure can be made uniform by the upper plate arranged on the upper opening end face of the honeycomb structure, so that the drying of the honeycomb structure is uniformly performed as a whole and consequently the dimensional accuracy of the honeycomb structure as a whole is improved, uniform moisture distribution can be achieved and cracking does not occurs.

Further, the density of electric force line can optionally be changed by varying the surface area of the upper plate, so that the moisture distribution in the honeycomb structure after the drying can optionally be controlled and consequently the shape thereof can well be controlled. That is, the ceramic honeycomb structure can be dried with a high dimensional accuracy.

Figure 1:
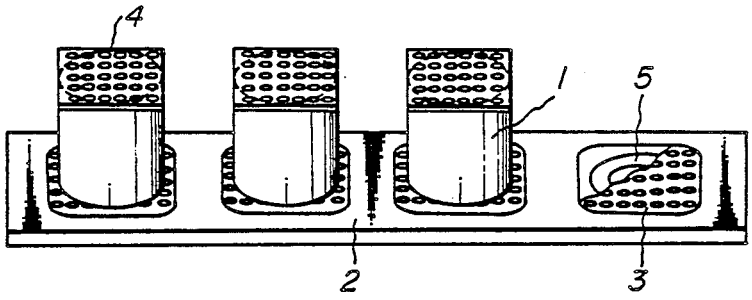
FIG. 1 is a perspective view of an embodiment practicing the dielectric drying process of the honeycomb structure according to the invention.

In FIG. 1 is shown a perspective view for illustrating the dielectric drying process of the honeycomb structure according to the invention, wherein plural honeycomb structures 1 are placed on a perforated plate 3 arranged in a support board 2 and also a perforated plate 4 as an upper plate is placed on the upper opening end face of each of the honeycomb structures 1. The perforated plate 4 has a conductivity higher than that of the honeycomb structure 1 and is preferably made from at least one material selected from the group consisting of non-magnetic aluminum, copper, aluminum alloy, copper alloy and graphite. As the perforated plate 4, there are provided several plates having different areas, among which a perforated plate suitable for obtaining desired form is selected. That is, the difference in size between the upper opening end face and the lower opening end face in the honeycomb structure can be controlled to about few millimeters by varying the surface area of the perforated plate 4 as an upper plate through this size difference is dependent upon the size of the honeycomb structure. On the other hand, the support board 2 is comprised by cutting out a portion wider by a given size than the end face of the honeycomb structure from the support board to form a hole 5 and then fitting a perforated plate 3 having a conductivity higher than that of the support board 2 and a surface area larger by a given ratio than the opening end area of the honeycomb structure into the hole 5 formed in the support board.

Figure 2:
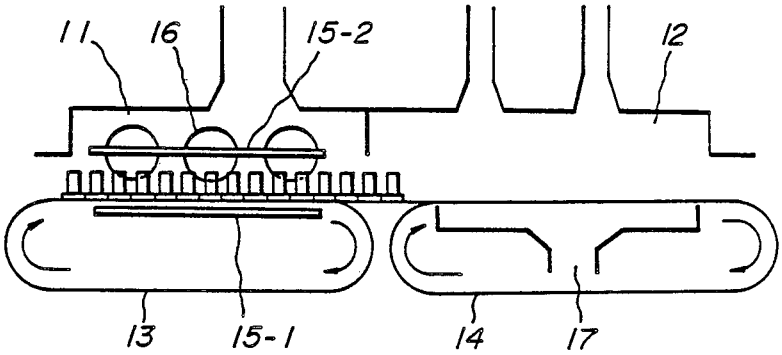
FIG. 2 is a diagrammatical view of the drying apparatus for practicing the dielectric drying process according to the invention.

In FIG. 2 is diagrammatically shown the drying apparatus suitable for practicing the dielectric drying process according to the invention. In the illustrated drying apparatus, a dielectric drying unit 11 and a draft drying unit 12 for completely drying the honeycomb structure are continuously connected to each other through a conveyor 13 for dielectric drying and a conveyor 14 for draft drying. The electirc drying unit 11 is constructed with the conveyor 13 for dielectric drying, electrodes 15-1, 15-2, arranged above the upper opening end face and beneath the lower opening end face so as to be parallel with the opening end faces of the honeycomb structure, and hot air ventilating holes 16 for ventilating hot air so as to prevent the dewing of steam generated in the drying onto the electrodes 15-1, 15-2 and the like. On the other hand, the draft drying unit 12 is provided with a conveyor 14, a hot air circulating duct 17 for completely drying the honeycomb structure after the dielectric drying so as to enable the cutting with a whetstone or to prevent the occurrence of cracks due to non-uniform shrinkage despite the firing. For instance, a hot air heated to a temperature of 80°–150° C. may be is fed from the hot air circulating duct 17 at a wind speed of 0.3–2.0 m/sec into the through-holes of the honeycomb structure.

The following example is given in illustration of the invention and is not intended as limitation thereof.

EXAMPLE

There were provided ceramic honeycomb structures 150 mm in height and 120 mm in diameter each made from cordierite, which were subjected to a dielectric drying with the use of upper plates having various shapes, areas and materials as shown in the following Table 1 to obtain samples No. 1–7 according to the invention. The term "area" used herein means a ratio to the surface area of the opening end face, such that an area which is the same as the opening end face area is represented by 100%. On the other hand, samples No. 8–9 of Comparative Examples were obtained by the same dielectric drying process as described in U.S. Pat No. 4,439,929 without using the upper plate for the honeycomb structure.

The moisture content in the central portion of the resulting sample after the drying was measured at upper, middle and lower positions in the height direction, and the diameters $D_1$ and $D_3$ of the opening end faces at the lower and upper ends were measured. The measured results are shown in Table 1.

TABLE 1

| Sample No. | | Upper plate shape | Upper plate area | Upper plate material | Moisture content in middle portion of product after dielectric drying (%) (lower position) | (middle position) | (upper position) | Diameter (mm) $D_1$ (lower portion) | $D_3$ (upper portion) | Diameter difference (mm) $D_3$–$D_1$ |
|---|---|---|---|---|---|---|---|---|---|---|
| Example | 1 | perforated | 100 | aluminum | 2.8 | 0.5 | 2.5 | 118.5 | 118.6 | +0.1 |
| | 2 | flat | 100 | aluminum | 3.0 | 0.6 | 7.2 | 118.3 | 118.8 | +0.5 |
| | 3 | perforated | 80 | copper | 2.5 | 0.6 | 3.1 | 118.4 | 118.5 | +0.1 |
| | 4 | perforated | 80 | brass | 2.6 | 0.6 | 3.2 | 118.3 | 118.5 | +0.2 |
| | 5 | perforated | 80 | aluminum | 2.7 | 0.5 | 3.0 | 118.4 | 118.6 | +0.2 |
| | 6 | perforated | 100 | aluminum | 2.5 | 0.5 | 2.5 | 118.6 | 118.7 | +0.1 |
| | 7 | perforated | 120 | aluminum | 2.5 | 0.4 | 4.0 | 118.7 | 118.5 | −0.2 |
| Comparative Example | 8 | | | | 2.6 | 1.5 | 14.0 | 118.4 | 119.4 | +1.0 |
| | 9 | | | | 3.0 | 1.5 | 12.0 | 118.3 | 119.3 | +1.0 |

Figure 3:
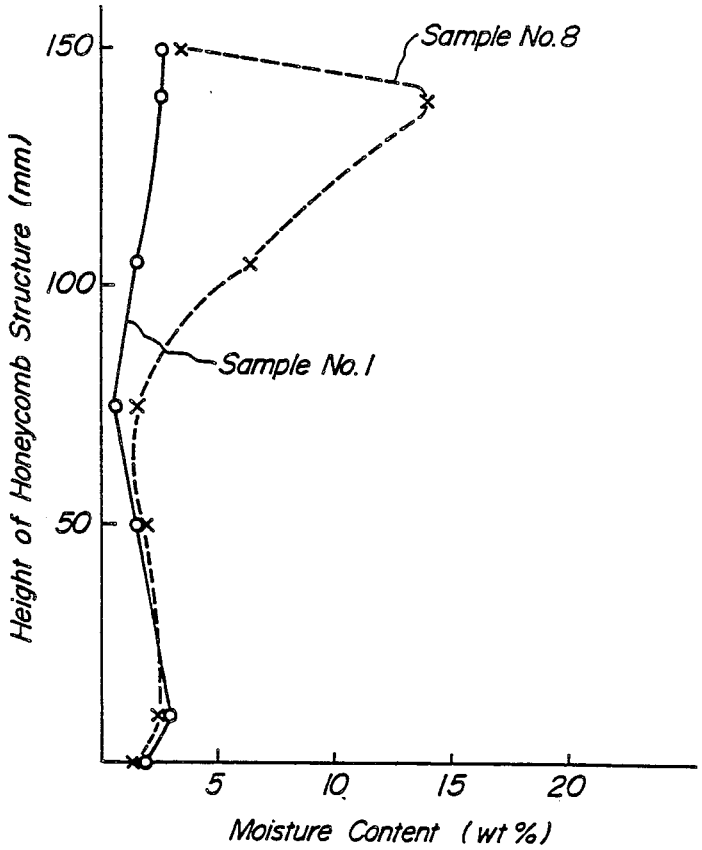
FIG. 3 is a graph showing a change of moisture content.

As seen from Table 1, the moisture content at the upper position in the samples No. 1–7 according to the invention is clearly lower than that of the samples No. 8–9 of Comparative Examples, and also the difference between the diameter $D_1$ of the lower end and the diameter $D_3$ of the upper end is very small. Moreover, the change of moisture content at each position in the central portion of the product in the samples No. 1 and 8 is shown in FIG. 3.

Furthermore, as seen from the results of samples No. 5–7 in Table 1, the difference in diameter between upper opening end and lower opening end is changed by varying the surface area of the upper plate, whereby the shape of the honeycomb structure after the drying can be controlled.

As mentioned above, according to the invention, the dielectric drying process is carried out by placing a given upper plate on the upper opening end face of the honeycomb structure placed on the support board provided with the given perforated plate, whereby the drying speed at each portion of the honeycomb structure is made uniform and the honeycomb structure having a uniform moisture distribution can be obtained and consequently the honeycomb structure having good dimensional accuracy can be obtained.

Furthermore, the moisture distribution can be controlled by varying the surface area of the upper plate, and consequently the shape of the honeycomb structure after the drying can be controlled.

What is claimed is:

1. A process for dielectric-drying a honeycomb structure comprising placing a honeycomb structure on a drying support board comprising a perforated plate, a given region of which inclusive of a portion contacting with a lower opening end face of the honeycomb structure has a conductivity higher than that of a second portion, placing an upper plate comprising a perforated plate made from at least one material selected from the group consisting of aluminum, copper, aluminum alloy, copper alloy and graphite, the upper plate having a conductivity higher than that of the honeycomb structure on an upper opening end face of the honeycomb structure, and directing an electric current between an electrode arranged above the upper opening end face of the honeycomb structure and an electrode arranged beneath the lower opening end face thereof to conduct the drying.

2. A process for dielectric-drying a honeycomb structure comprising placing a honeycomb structure on a drying support board comprising a perforated plate, a given region of which inclusive of a portion containing with a lower opening end face of the honeycomb structure has a conductivity higher than that of a second portion, placing an upper plate having a conductivity higher than that of the honeycomb structure on an upper opening end face of the honeycomb structure, and directing an electric current between an electrode arranged above the upper opening end face of the honeycomb structure and an electrode arranged beneath the lower opening end face thereof to conduct the drying, wherein an area of said upper plate is varied to control a shape of the honeycomb structure after the drying.

* * * * *